United States Patent [19]

Kamei

[11] Patent Number: 4,518,027

[45] Date of Patent: May 21, 1985

[54] MOLD ADAPTED TO HOUSE ELECTROMAGNETIC STIRRER COIL FOR CONTINUOUS CASTING EQUIPMENT

[75] Inventor: Futoshi Kamei, Kobe, Japan

[73] Assignee: Kabushiki Kaisha Kobe Seiko Sho, Kobe, Japan

[21] Appl. No.: 576,806

[22] Filed: Feb. 6, 1984

Related U.S. Application Data

[63] Continuation of Ser. No. 248,209, Mar. 27, 1981, abandoned.

[30] Foreign Application Priority Data

Mar. 29, 1980 [JP] Japan ..... 55-40728

[51] Int. Cl.[3] ..... B22D 11/04

[52] U.S. Cl. ..... 164/435; 164/468; 164/504

[58] Field of Search ..... 164/137, 418, 435, 436, 164/443, 467, 468, 499, 502, 503, 504

[56] References Cited

U.S. PATENT DOCUMENTS

| | | | |
|---|---|---|---|
| 3,170,204 | 2/1965 | Tarmann | 428/675 |
| 3,228,071 | 1/1966 | Schultz | 164/435 |
| 3,595,302 | 7/1971 | Mallener | 164/283 |
| 3,709,286 | 1/1973 | Bower, Jr. | 164/283 |
| 3,866,664 | 2/1975 | Auman et al. | 164/283 |
| 3,967,673 | 7/1976 | Bower, Jr. | 164/82 |
| 4,009,749 | 3/1977 | Alberny | 164/504 |
| 4,182,397 | 1/1980 | Schmucker et al. | 164/443 |
| 4,197,902 | 4/1980 | Von Jan et al. | 164/418 |

FOREIGN PATENT DOCUMENTS

| | | | |
|---|---|---|---|
| 681844 | 3/1964 | Canada | 164/443 |
| 2324395 | 4/1977 | France . | |
| 2382295 | 2/1978 | France . | |
| 2393632 | 1/1979 | France . | |
| 962259 | 1/1964 | United Kingdom | 164/435 |

*Primary Examiner*—Nicholas P. Godici
*Assistant Examiner*—Maureen Weikert
*Attorney, Agent, or Firm*—Oblon, Fisher, Spivak, McClelland & Maier

[57] ABSTRACT

A mold for continuous casting of a magnetic metal includes a thin copper mold wall, a backup piece formed of a non-magnetic material serving to support the thin copper mold wall, passageways for a cooling medium between the thin copper mold wall and the backup piece, a clamping piece for clamping the backup piece against the thin copper mold wall, and an electromagnetic stirrer coil located between the backup piece and the clamping piece.

5 Claims, 6 Drawing Figures

MOLD ADAPTED TO HOUSE ELECTROMAGNETIC STIRRER COIL FOR CONTINUOUS CASTING EQUIPMENT

This application is a continuation of application Ser. No. 248,209, filed Mar. 27, 1981, now abandoned.

BACKGROUND OF THE INVENTION

1. Field of the Invention

The present invention relates to a mold adapted to house an electromagnetic stirrer coil for continuous casting equipment.

2. Description of the Prior Art

Recently, continuous casting equipment which is designed for production of higher steel grades has been provided with an electromagnetic stirrer adapted to impart fluid motion to the molten steel in a copper-walled mold to provide an increased proportion of equiaxed crystals and satisfactory float-up of the inclusions.

Electromagnetic stirrers of this type are based on the principle of induction motors and include an electromagnetic coil disposed around the outer periphery of the copper wall of the mold to produce a revolving magnetic field to thereby impart fluid motion to the molten steel in the copper-walled mold.

The conventional mold is formed of a copper plate having a substantial thickness to suppress the thermal expansive bending of the mold wall due to the molten steel, but the use of such copper plate of large thickness results in decreasing the magnetic permeation of magnetic forces produced by an electromagnetic coil placed around the mold, thus causing a fatal drawback that the electromagnetic stirring of the molten steel in the mold cannot be efficiently effected.

SUMMARY OF THE INVENTION

The present invention has been accomplished in view of the above problem in the conventional mold and has for its object the provision of a mold adapted to house an electromagnetic coil for efficient electromagnetic stirring of the molten steel contained therein, the mold being arranged so that the installation of the electromagnetic coil is easy and the entire device is compact.

A first form of the present invention includes a mold copper wall in the form of a quadrangular prism composed of four thin plane copper plates, backup plates joined together at their sides to support the copper plates, cooling medium passageways defined between the backup plates and the copper plates, a pair of clamp frames for clamping the backup plates therebetween, and a space for housing the electromagnetic coil defined between the backup plates and the clamp frames.

This and other forms of the invention will be fully described below.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMODIMENTS

A mold copper wall 1 is composed of four thin plane copper plates 1*a*, 1*a'*, 1*b*, 1*b'*. In this embodiment, one pair of copper plates 1*a*, 1*a'* are wide, while the other pair of copper plates 1*b*, 1*b'* are narrow. The narrow steel plates 1*b*, 1*b'* each have on opposite sides thereof projections 1*c* which form the rounded corners of the quadrangular copper wall, and the other pair of wide steel plates 1*a*, 1*a'* are arranged with their lateral end surfaces 1*d* abutting against the end surfaces 1*e* of said projections 1*c*.

Copper plates 1*a*, 1*a'*, 1*b*, 1*b'* are supported respectively by backup plates 2*a*, 2*a'*, 2*b*, 2*b'* of nonmagnetic material. More particularly, as shown in FIGS. 2–5, each backup plate has a plurality of bolt holes 3*a*, while each copper plate has stud bolts 3 fixed on the back thereof at positions corresponding to the bolt holes 3*a* so that the stud bolts are inserted into the bolt holes 3*a*, whereupon nuts are applied to tighten the stud bolts. Bolt holes 3*a* have a sufficient diameter to allow for movement of the stud bolts upon thermal expansion of the copper plates.

Each backup plate has a plurality of widthwise extending water passageways S16, S9 in the upper and lower regions and vertical water passageways S10 on the surface thereof opposed to the associated copper plate for establishing communication between the upper and lower water passageways S16 and S9.

Figure 2:
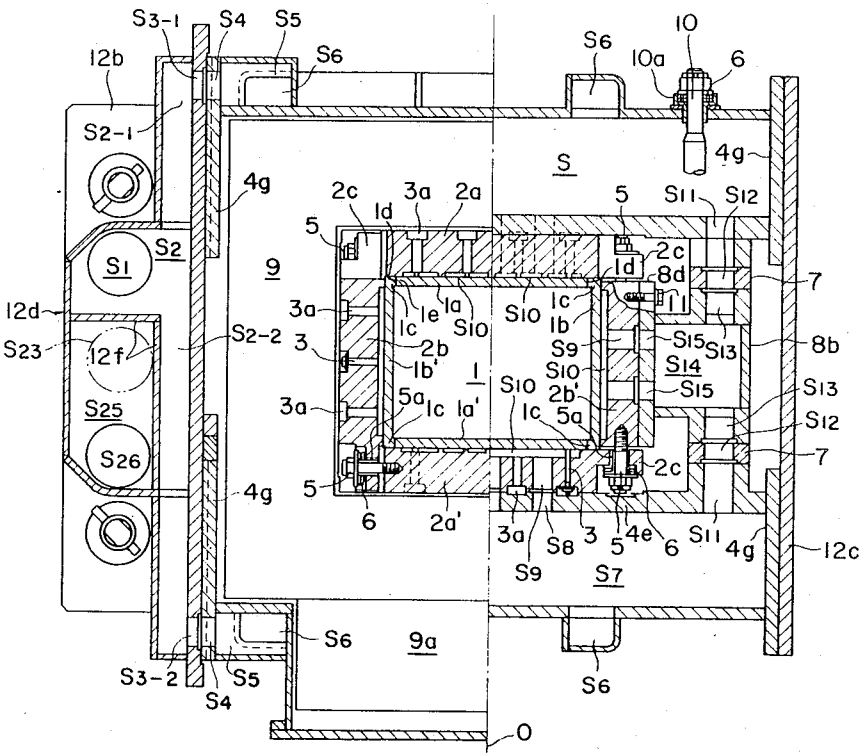
FIG. 2 is stepwise sectioned view taken along the line II—II of FIG. 4.

Opposite sides of each backup plate are undulated, as shown in FIGS. 2–5, which ridges 2*c* on the sides of each backup plate received in recesses 2*d* in the sides of adjacent backup plates (clasp joint) and, as best seen in FIG. 2, bolts 5 are inserted into holes 5*a* in the ridges 2*c* and screwed into the recesses 2*d*. Each bolt 5 has a dished spring 6 fitted thereon to allow some movement of the backup plates at right angles thereto. In addition, holes 5*a*, like bolts holes 3*a*, have a diameter somewhat larger than the diameter of the bolts 5 so that adjacent backup plates can be somewhat moved at right angles to each other.

By assembling the backup plates 2*a*, 2*a'*, 2*b*, 2*b'* in the manner described above, the opposite end surfaces 1*d* of the pair of wide copper plates 1*a*, 1*a'* are pressed against the end surfaces 1*e* of the ridges on the pair of narrow copper plates 1*b*, 1*b'*; the opposite end surfaces 1*f* of the pair of narrow copper plates 1*b*, 1*b'* and the back surfaces of the pair of wide copper plates 1*a*, 1*a'* are pressed against the pair of wide backup plates 2*a*, 2*a'*, and the back surfaces of the pair of narrow copper plates 1*b*, 1*b'* are pressed against the pair of narrow backup plates 2*b*, 2*b'*.

A space for housing an electromagnetic coil 9 is defined between the outer peripheries of the backup plates 2 assembled in quadrangular prism form, as described above, and clamp frames 4*a*, 4*b* to be later described. The electromagnetic coil 9 housed in this space is supported from below by brackets 2*c'* provided on the lower portions of the back surfaces of the backup plates.

Figure 3:
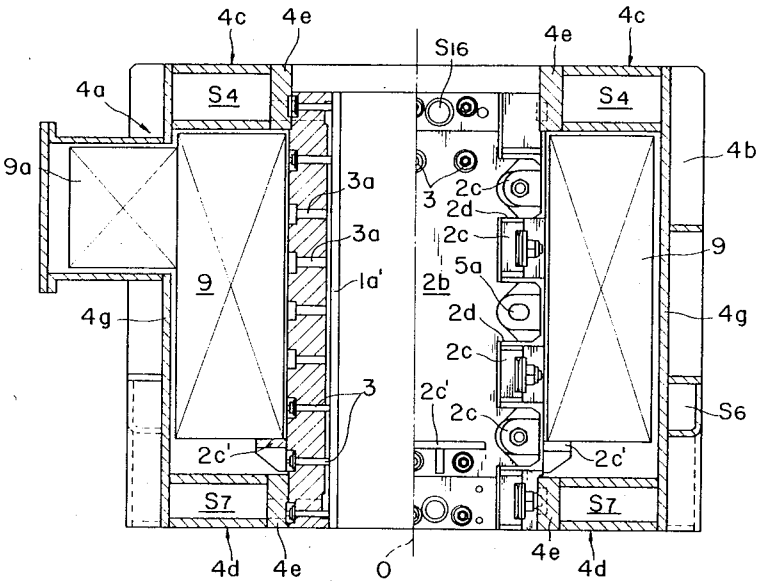
FIG. 3 is a stepwise sectioned view taken along the line III—III of FIG. 1.

In addition, the portion 9*a* shown in FIGS. 2 and 3 denotes the connector portion of the electromagnetic coil 9. As shown, the height of the space for housing the electromagnetic coil 9 is smaller than that of the backup plates 2 so that in the mounted state, the upper and lower portions of the backup plates 2 extend beyond the electromagnetic coil 9.

Figure 1:
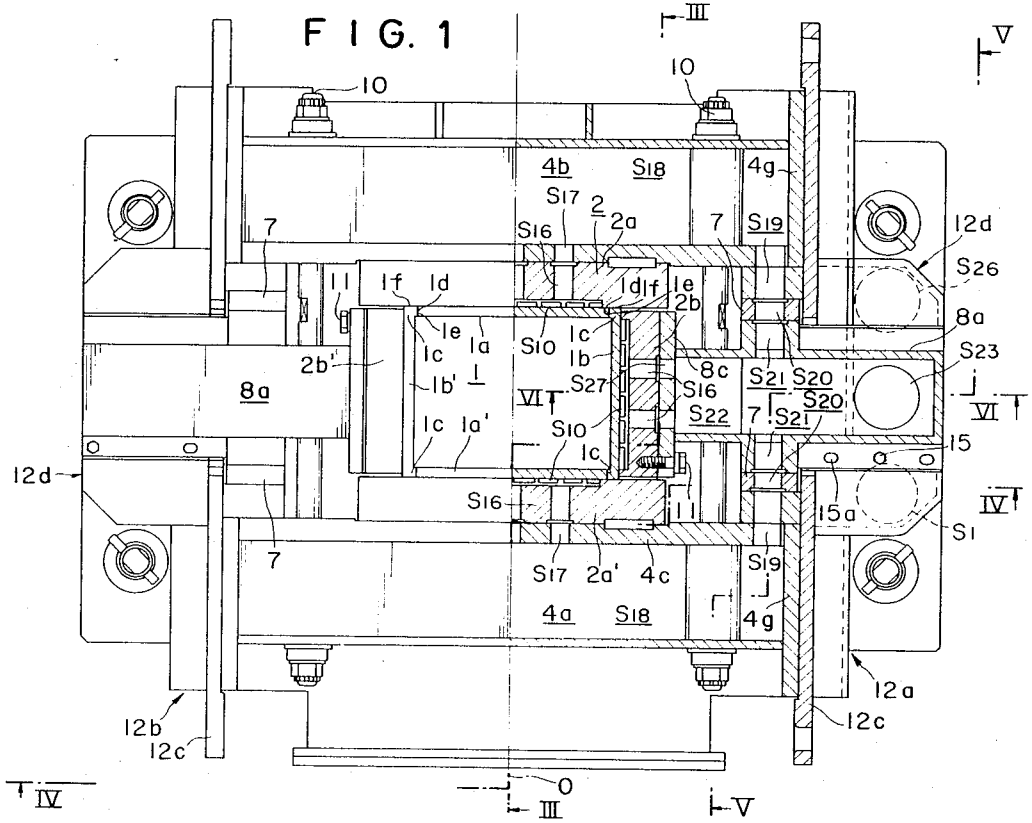
FIG. 1 is a half-sectioned view taken along line I—I of FIG. 4.
Figure 6:
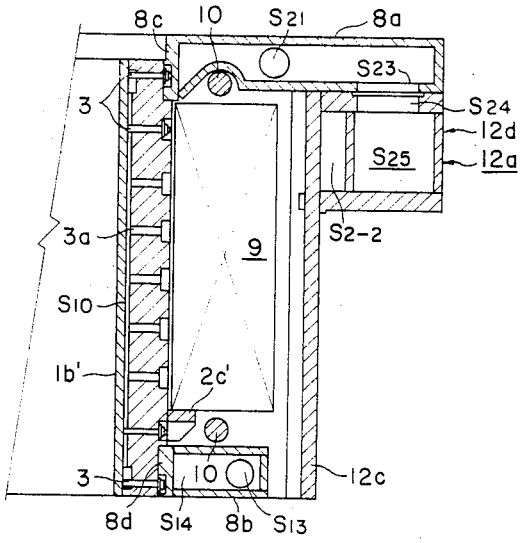
FIG. 6 is a fragmentary sectional view showing part of FIG. 1.

The pair of narrow backup plates 2*b*, 2*b*′ have upper water passage boxes 8*a* fixed to the upper regions of the back surfaces thereof by bolts 11, as shown in FIGS. 1 and 6, and lower water passage boxes 8*b* fixed to the lower regions of the back surfaces thereof by bolts 11, as shown in FIGS. 2 and 6. The fixing walls 8*c* of the upper water passage boxes 8*a* in contact with the backup plates 2*b*, 2*b*′ have water passage holes S27 communicating with the upper water passage holes S16 of the backup plates 2*b*, 2*b*′. Further, the fixing walls 8*d* of the lower water passage boxes 8*b* in contact with the backup plates 2*b*, 2*b*′ have water passage holes S15 communicating with the lower water passage holes S9 of the backup plates 2*b*, 2*b*′.

Figure 5:
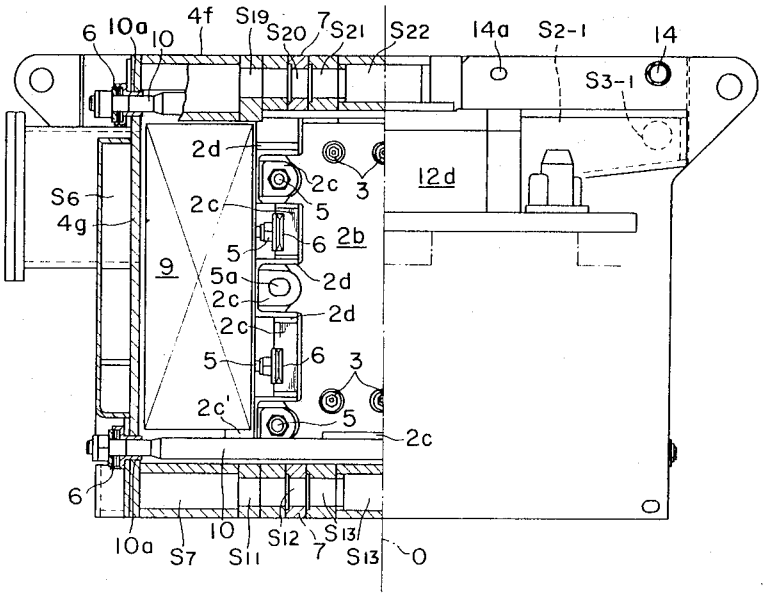
FIG. 5 is a stepwise sectioned view taken along the line V—V of FIG. 1.

Backup plates 2 provided with the electromagnetic coil 9 around their outer peripheries and with the upper and lower water passage boxes 8*a*, 8*a*′ and 8*b*, 8*b*′ are clamped by a pair of clamp frames 4*a*, 4*b*. The pair of clamp frames 4*a*, 4*b*, as best seen in FIG. 3, have box portions 4*c*, 4*d* in the upper and lower regions thereof forming water passageways S4 and S7, the end walls 4*e* of said box portions 4*c*, 4*d* abutting against the upper and lower regions of the back surfaces of the pair of wide backup plates 2*a*, 2*b*, the assembly being clamped by four tie rods 10. Each tie rod 10, as best seen in FIGS. 2 and 5, has dished springs 6 fitted thereon at opposite ends, each dished spring being supported on a seat 10*a*. Thus, when the narrow copper plates 1*b*, 1*b*′ are thermally expanded in the direction of the width to cause some outward movement of the wide backup plates 2*a*, 2*a*′ at right angles thereto, the pair of clamp frames 4*a*, 4*b* are allowed to expand because of the contraction of the dished springs 6.

Figure 4:
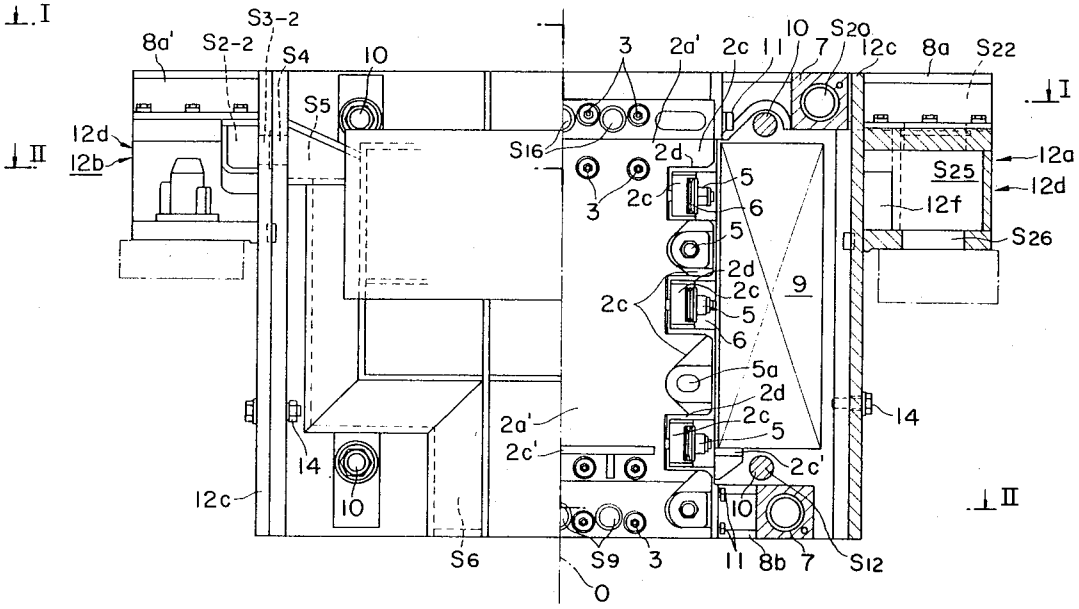
FIG. 4 is a stepwise sectioned view taken along the line IV—IV of FIG. 1.

Clamp frames 4*a*, 4*b* each have a plurality of water passageways or water passage holes in addition to the upper and lower water passageways S4, S7. More particularly, as shown in FIGS. 2 and 4, clamp frames 4*a*, 4*b* have water passage holes S4 formed in the outer walls 4*g* of the clamp frames 4*a*, 4*b*, water passageways S5 communicating with water passage holes S4, and water passageways S6 communicating with water passageways 5 and extending downwardly in a bent path to communicate with water passageways S7. FIG. 2 shows different sections on both sides of the center axis 0, but the water passage relation is symmetrical with respect to the center axis 0. The clamp frames have water passageways S17 in the end walls 4*e* of the upper box portions 4*c* communicating with the upper passage holes S16 in the wide backup plates 2*a*, 2*b*, and communication holes S8 which communicate with the lower water passage holes S9 in wide backup plates 2*a*, 2*a*′. Further, water passageways S19 are provided on both sides of the end walls 4*e* of the upper box portions 4*c* and water passageways S11 on both sides of the end walls 4*e* of the lower box portions 4*d*. Water passageways S19 communicate with the water passageways S21 of the upper water boxes 8*a* through blocks 7 having water passageways S20, while water passageways S11 communicate with water passageways S11 of the lower water passage boxes 8*b* through blocks 7 having water passageways S12. In addition, the connection to blocks 7 is such that even if the upper and lower water passage boxes 8*a*, 8*b* and clamp frames 4*a*, 4*b* move somewhat in any direction relative to the blocks 7, sealing is maintained by using seal members, such as U-packings.

The pair of clamp frames 4*a*, 4*b* with the backup plates 2 clamped therebetween as described above are mounted by a pair of hanger frames 12*a*, 12*b*. Hanger frames 12*a*, 12*b* are installed on the mold mount (not shown) of the continuous casting equipment.

The present embodiment is constructed so that the pair of hanger frames mount the clamp frames for the purpose of installation of the mold, but opposite ends of the clamp frames may be modified to provide cooling passageways therein and a mold installing function. For example, opposite ends of the clamp frames may be provided with extensions which run parallel to the backup plates 2*b*, 2*b*′ and which have a construction similar to hanger plates to be later described. Clamp frames 4*a*, 4*b* in the present embodiment are designed so that the side walls 4*g* are fixed to the side walls 12*c* of the hanger frames 12*a*, 12*b* by bolts 14. This arrangement is best shown in FIG. 5. This fixing, however, is such that the clamp frames 4*a*, 4*b* are allowed to move somewhat relative to the hanger frames 12*a*, 12*b* in consideration of the fact that the clamp frames 4*a*, 4*b* move during thermal expansion of the copper wall 1, as described above. More particularly, the bolt receiving holes 14*a* of the hanger frames 12*a*, 12*b* are elongated and bolts 14 screwed into the side walls 4*g* of the clamp frames are allowed to move somewhat together with the clamp frames 4*a*, 4*b* relative to the hanger frames 12*a*, 12*b*.

Further, the upper water passage boxes 8*a* mounted on the narrow backup plates 2*b*, 2*b*′ are fixed to the hanger frames by bolts 15. This fixing, however, as in the case of fixing by bolts 14, is such that the bolt receiving holes 15*a* of the upper water passage boxes 8*a* are elongated so that the upper water passage boxes 8*a* may move together with the narrow backup plates 2*b*, 2*b*′ during thermal expansion of the copper wall 1. The pair of hanger frames 12*a*, 12*b* have water passage box portions 12*d* in the upper regions thereof and internally have a plurality of water passageways and water passage holes, the arrangement thereof being in point symmetry relation.

As shown in FIG. 2, the water passage boxes 12*d* of the hanger frames 12*a*, 12*b* each have partition walls 12*f* to divide the interior into water passageways S2 and S25. One water passageway S2 communicates with the water passage hole S1 which serves to introduce cooling water, and also communicates with water passageways S2-1 and S2-2 which branch off. In this case, if the portions of the hanger frames corresponding to the front ends of the water passage holes S1 are provided with connectors adapted to connect to the water supply connectors on the mold mount, this will lead to simplification of mold installation and cost reduction. The water passageways S2-1 and S2-2 communicate with water passageways S3-1 and S3-2, respectively, formed in the side walls 12*c*, while water passageways S3-1 and S3-2 communicate with water passage holes S4 formed in the side walls 4*g* of the clamp frames 4*a*, 4*b*. The other water passageway S35, as best shown in FIG. 6, has a water passage hole S24 communicating with a water passage hole S23 formed in the upper water passage box 8*a* and, as best shown in FIG. 4, has a water passage hole S26 for discharging the cooling water.

The construction of the mold according to this embodiment is as described above, and the cooling water flows as follows. The cooling water is introduced into the water passageways S2 via the water passage holes S1 in the water passage boxes 12*d* of the hanger frames 12*a*, 12*b*. The cooling water then bifurcates and flows into the water passageways S2-1 and S2-2. From there is flows into and then into the water passageways S5 via the water passage holes S3-1 and S3-2 and the water passage holes S4 in the clamp frames 4*a*, 4*b*. The cooling water then flows downwardly through the water passageways S6 and enters the water passageways S7 in the lower water passage boxes 4*d* of the clamp frames 4*a*, 4*b*. Subsequently, the water flows through the water passage holes S8 and the water passage holes S9 in the wide backup plates 2*a*, 2*a'* or through the water passage holes S11, water passageways S12 in the blocks 7, water passageways S13 and S14 in the lower water passage boxes 8*b*, water passage holes S15 and water passage holes S9 in the narrow backup plates 2*b*, 2*b'*, and enters the lower regions of the water passageways S10. From there it moves upwardly through the water passageways S10 and then through the water passage holes S16 in the wide backup plates 2*a*, 2*a'* and water passage holes S17 in the upper water passage boxes 4*c* of the narrow frames 4*a*, 4*b* to enter the water passageways S18. It also flows through the water passage holes S16 in the narrow backup plates 2*b*, 2*b'* and water passage holes S27 in the upper water passage boxes 8*a* to enter the water passageways S22. The cooling water in the water passageways S22 flows through the water passage holes S23, through the water passage holes S24 in the water passage box portions 12*d* of the hanger plates 12*a*, 12*b*, and into the water passage holes S25, from which it is then discharged through the water passage holes S26.

In addition, the cooling of the electromagnetic coil itself is effected by hollowing out the winding of the coil and passing cooling water through the hollow space.

As is apparent from the above description of the presently preferred embodiment, since the mold adapted to house an electromagnetic stirrer coil for continuous casting equipment according to the present invention is of assembled construction with the mold copper wall, backup plates, etc., as separate components rather than being integrated, the production thereof is very easy and inexpensive. The support provided by the backup plates permits the mold copper wall to be thin, which ensures trouble-free electromagnetic stirring. Further, because of the construction in which a space for housing the electromagnetic coil is defined between the backup plates and the clamp frames, the installation of the electromagnetic coil is extremely facilitated and the entire mold is compact.

Obviously, numerous modifications and variations of the present invention are possible in light of the above teachings. It is therefore to be understood that within the scope of the appended claims, the invention may be practiced otherwise than as specifically described herein.

What is claimed is:

1. A mold for continuous casting of a magnetic metal, said mold comprising:

(a) a thin copper mold wall in the form of a quadrangular prism formed of four planar copper plates, two opposing ones of said four planar copper plates having flange-shaped projections extending perpendicularly from the ends of said two opposing ones of said four planar copper plates in facing relationship and the other two of said four planar copper plates, which are also in opposing relationship to one another, abutting against the end surfaces of said flange-shaped projections;

(b) a backup piece in the form of four backup plates fastened together at their sides, said backup piece being formed of a non-magnetic material serving to support said thin copper mold wall, a backup portion of a first two of said four backup plates abutting and giving direct planar support to said two opposing ones of said four planar copper plates and being slightly shorter than said two opposing ones of said four planar copper plates and a second two of said four backup plates abutting and giving direct planar support to said other two of said four planar copper plates and to the outer edges of said flange-shaped projections on said two opposing ones of said four planar copper plates, said second two of said four backup plates overlapping the ends of said first two of said four backup plates in engaging relationship;

(c) passageways for a cooling medium between said thin copper mold wall and said backup piece;

(d) a clamping piece in the form of a pair of clamping frames for clamping said backup piece against said thin copper mold wall;

(e) an electromagnetic stirrer coil located between said backup piece and said clamping piece;

(f) fastener bolts mounted on each end of each backup plate for fastening each adjacent pair of said backup plates together, each bolt having spring means which allows for limited movement of each of said backup plates perpendicularly to each of the adjacent ones of said backup plates; and (g) tie rods having spring means for fastening said clamping frames together so as to allow for limited movement of said clamping frames relative to each other.

2. A mold as recited in claim 1 wherein said two opposing ones of said four planar copper plates are substantially shorter than said other two of said four planar copper plates.

3. A mold as recited in claim 1 wherein said stirrer coil is quadrangular in cross-section.

4. A mold as recited in claim 1 wherein said stirrer coil is continuous in the direction of the length of the mold.

5. A mold as recited in claim 1 wherein said stirrer coil is continuous in the direction of the height of the mold for at least more than one half of the height of the mold.

* * * * *